United States Patent [19]

Umebayashi

[11] Patent Number: 4,899,629

[45] Date of Patent: Feb. 13, 1990

[54] METHOD FOR DISCARDING SHEET MATERIAL

[75] Inventor: Hiroki Umebayashi, Kanagawa, Japan

[73] Assignee: Fuji Photo Film Co., Ltd., Kanagawa, Japan

[21] Appl. No.: 160,044

[22] Filed: Feb. 24, 1988

[30] Foreign Application Priority Data

Feb. 25, 1987 [JP] Japan ..... 62-40426

[51] Int. Cl.[4] ..... B41J 11/70; B26D 5/20

[52] U.S. Cl. ..... 83/38; 83/56; 83/167; 83/370

[58] Field of Search ..... 83/23, 56, 167, 334, 83/335, 339, 343, 364, 365, 369, 370, 923, 86, 111, 156, 37, 38, 923

[56] References Cited

U.S. PATENT DOCUMENTS 3,834,262 9/1974 Lapper ..... 83/369
4,183,271 1/1980 Martin ..... 83/156
4,297,930 11/1981 Putzke ..... 83/156
4,437,370 3/1984 Philipp et al. ..... 83/23
4,557,169 12/1985 Kajiaya et al. ..... 83/156
4,709,869 12/1987 Kashiwaba ..... 83/37

FOREIGN PATENT DOCUMENTS 1230994 5/1971 Canada ..... 83/369

*Primary Examiner*—Hien H. Phan
*Attorney, Agent, or Firm*—Sughrue, Mion, Zinn, Macpeak & Seas

[57] ABSTRACT

A method for discarding sheets of used photosensitive material from an image or the like wherein the amount of discarded sheets which can be held in a storage box is increased. Used photosensitive sheets are conveyed to a discarding section where they are cut off in lengths sufficiency short that the sheets cannot fold on themselves when placed in the storage box but sufficiently long that they can be conveyed in the apparatus.

1 Claim, 2 Drawing Sheets

METHOD FOR DISCARDING SHEET MATERIAL

BACKGROUND OF THE INVENTION

The present invention relates to a method of discarding unwanted sheets of material from an image recorder or the like.

An image recording method in which a photosensitive material and an image-receiving material are used to record an image is disclosed in commonly assigned Japanese Patent Application No. 121284/85. In this method, a recording material having a coating of a photosensitive composition is employed. In the photosensitive composition, a carrier is coated with at least a photosensitive silver halide, a reducing agent, a polymerizable compound and a color image forming substance. At least the polymerizable compound and the color image forming substance are encapsulated in mirocapsules. The photosensitive material is exposed to imaging rays of light to form a latent image on the photosensitive material. The photosensitive material is thereafter developed by heating in such a manner that the polymerizable compound of each portion in which the latent image is present is polymerized to form a high-molecular compound so as to harden the microcapsules. In those areas. Subsequently, the photosensitive material is overlaid on the image-receiving material, which has an image-receiving layer to which the color image forming substance can be transferred. The photosensitive material and the image-receiving material are pressed against other so that at least part of the microcapsules in each area in which not latent image is present are ruptured to transfer the color image forming substance in those areas to the image-receiving material. As a result, the image is recorded on the image-receiving material. After the color image forming substance has been transferred to the image receiving material in the above manner the photosensitive material is sent to a discarding section.

If the discarding section is constructed of a tray which accommodates a photosensitive material of relatively large size, such as a sheet of size A3 or A4, the tray must be so large that at least a portion of it projects from the image recorder. Therefore, there is a disadvantage that it is necessary to provide a space to accommodate the projecting tray.

In order to eliminate this disadvantage, a storage box can be provided into which the photosensitive material is passed while the material folds on itself. However, because the material can curve in various manners in the box and gaps occur between the folded portions of the material, there is a drawback in that the number of sheets of photosensitive material which can be accommodated is very small, particularly if the box is shallow.

SUMMARY OF THE INVENTION

The present invention was made in order to eliminate the above-mentioned disadvantages and draw backs.

Accordingly, it is an object of the present invention to provide a method for holding a large number of discarded sheets without having to provide a large storage box or the like.

In a method provided in accordance with the present invention, each of the sheets discarded from an image recorder is cut off by a cutter immediately before the sheet is passed into a storage box. The cut-off length of the sheet is made sufficiently short so that the sheet will not fold on itself in the storage box but longer than the minimum length which makes it possible to convey the sheet in the image recorder. In other words, the discarded sheet is cut off by the cutter to such a length that the cut-off portions of the sheet are prevented from folding on themselves in the storage box. Hence, because no gaps occur between folded portions, the number of sheets which can be held in the storage box is increased.

DESCRIPTION OF THE PREFERRED EMBODIMENTS

A preferred embodiment of the present invention, which is a method of passing spent photosensitive material into a storage box, will hereafter be described with reference to the accompanying drawings.

Figure 1:
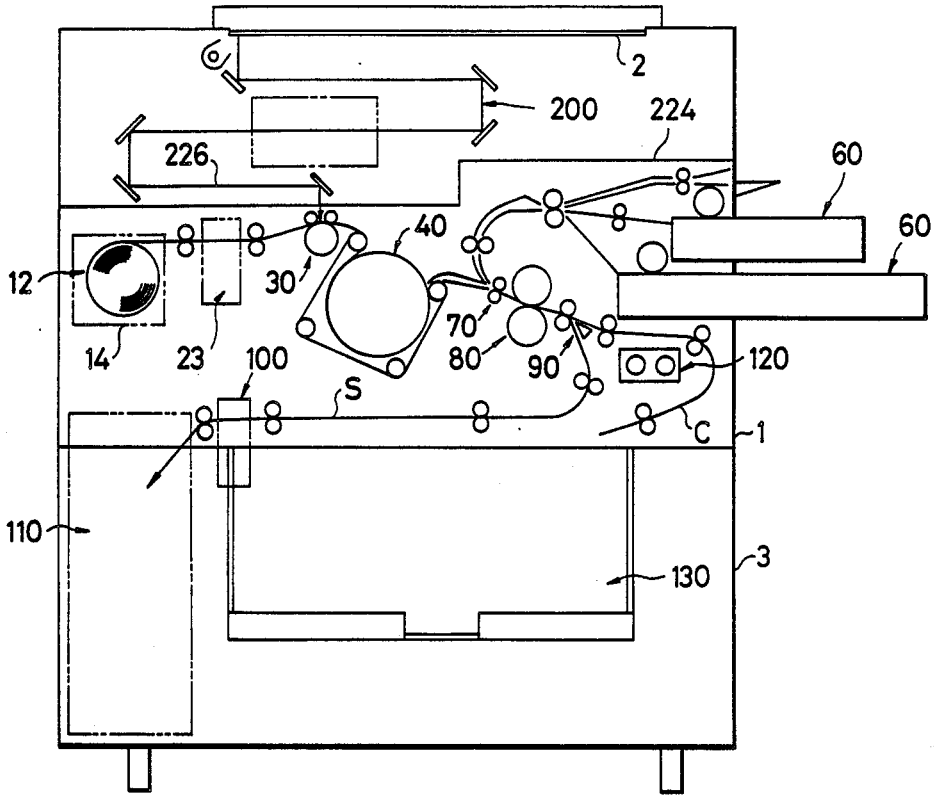
FIG. 1 shows a schematic view of an image recorder to which the method of the present invention is applied.

FIG. 1 shows an image recorder to which the inventive method is applied. In the image recorder, a glass plate 2 for supporting the original is attached to top of a case 1, and an exposure unit 200 is provided under the glass plate. The exposure unit 200 and a lower unit 3 are isolated from each other by a partition 224. A photosensitive material cartridge 14 containing a photosensitive material supply roller 12 on which a supply of photosensitive material S is wound is removably attached at a side of the casing 1 The photosensitive material S from the cartridge 14 is cut off to a prescribed length by a cutoff unit 23. In an exposure section 30, the cut-off photosensitive material S is exposed to imaging rays of light transmitted along an optical axis 226. The photosensitive material S is thereafter developed through heating by a thermal developing unit 40. After that step, the photosensitive material S and image-receiving paper C from an image-receiving paper feeder 60 are placed one on the other and subjected to a pressure of about 500 kg/cm$^2$ by a pressure transfer unit 80 so that an image is transferred from the photosensitive material to the image-receiving paper. After the transfer, the photosensitive material S and the image-receiving paper C are separated by a separation unit 90 and the separated photosensitive material is cut off by a cutoff unit 100. The cut-off segments of the photosensitive material are discarded into the photosensitive material storage box 110, while the image-receiving paper is subjected to fixation by a fixation unit 120 and sent to a takeout tray 130.

Figure 2:
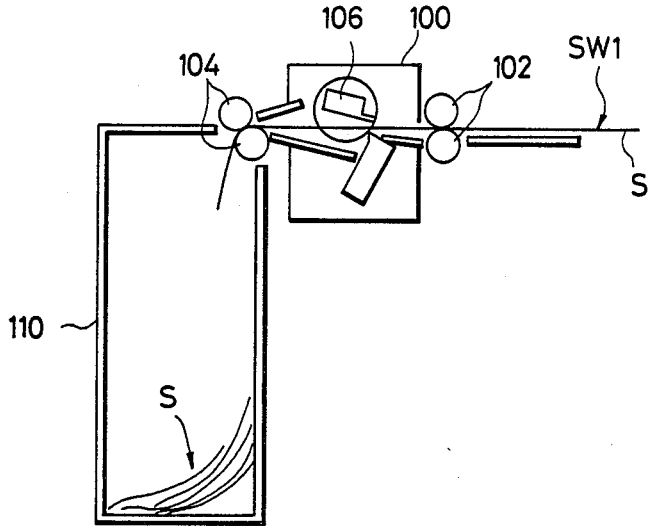
FIG. 2 shows a schematic view of a discarding section.
Figure 3:
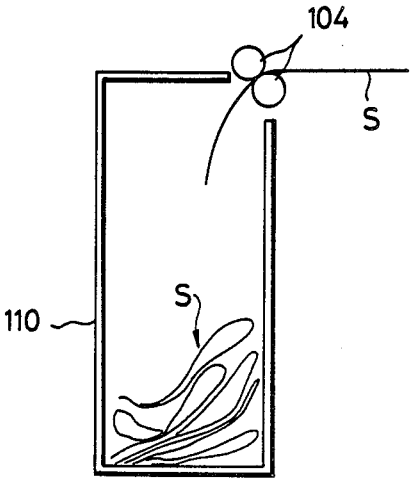
FIG. 3 shows the state of entrance of an uncut photosensitive material.

FIG. 2 shows the cutoff unit 100 and the photosensitive material storage box 104. Their passage of the photosensitive material S conveyed from the separation unit 90 is detected by a sensor switch $SW_1$ and the material S is pinched by conveyance rollers 102 and then by discharge rollers 104. After that, the photosensitive material S is cut off by the rotary cutter 106 of the cutoff unit 100 located between the pair of the conveyances rollers 201 and the discharge rollers 104 and is then discarded into the storage box 110. The sensor switch $SW_1$ is provided upstream of the conveyance rollers 102 at a position such that the distance between the switch and the rotary cutter 106 is not less than that between the conveyance rollers 102 and the discharge rollers 104.

As soon as the sensor switch $SW_1$ is turned on by the arrival there of the photosensitive material S, a time counting operation is commenced. The rotary cutter 106 is activated when the count has reached a value indicating that the distance between the rotary cutter and the front edge of the photosensitive material, having passed through between the discharge rollers 104, is equal to a predetermined length, for example, equal to the length of one edge of a standard A4-size sheet. If the sensor switch $SW_1$ is turned off before the rotary cutter 106 is activated, the photosensitive material S is not cut because the photosensitive material portion remaining after cutoff could not be conveyed. Since the maximum size of the paper used in the exemptitive image recorder is A3, the above-mentioned preset length is made equal to the length of the short edge of the A4-size sheet so that the photosensitive material S needs to be cut off only once. The bottom inside surface of the storage box 110 is made sufficiently long that the discarded photosensitive material M cut off to A4 does not fold on itself in the storage box. The preset length is normally made such, depending on the elasticity of the base of the photosensitive material S and the length of the bottom of the inside surface of the storage box 110 in the direction of conveyance of the discarded photosensitive material, that the discarded photosensitive material does not fold on itself in the storage box. As a result, it is not necessary to greatly restrict the length of the photosensitive material S which is used in the image recorder.

Although the above example of the inventive method is applied to an image recorder in which the photosensitive material and the image-receiving paper are overlaid and the image is transferred from the photosensitive material to the image-receiving paper, the invention is not confined to that application and may be applied to various other devices from which necessary sheets are discarded.

In a method provided in accordance with the present invention, a discarded material is cut off to such a length that the cut-off material does not fold on itself in the storage box. As a result, the gaps between segments of the cut-off material in the storage box are made sufficiently small that the density of discarded material in the storage box is high.

What is claimed is:

1. A method of discarding a sheet from an image recorder into a storage box having a bottom of a specified width, comprising the steps of:

detecting the conveyance of said sheet with a sensor at a position upstream of a cutter positioned between first and second pairs of conveyance rollers;

starting a time count when conveyance of said sheet is detected; and cutting said sheet to a cut-off length when the time count reaches a value indicating that said cut-off length of said sheet is greater than a distance between said first and second rollers and less than said width of the bottom of the box, wherein prior to said step of cutting said sheet to said cut-off length, said sensor and said cutter are separated by a distance not smaller than said distance between said first and second rollers whereupon if said sensor no longer senses said sheet, said time count is terminated so that said sheet is not cut to insure that said sheet maintains a length not less than said distance between said first and second rollers thereby permitting conveyance thereof from said recorder.

* * * * *